US008118548B2

(12) United States Patent
Nigmatulin et al.

(10) Patent No.: US 8,118,548 B2
(45) Date of Patent: Feb. 21, 2012

(54) SHROUD FOR A TURBOMACHINE

(75) Inventors: Tagir Robert Nigmatulin, Moscow (RU); Charles Alan Bulgrin, Avon, IN (US); Iain Robertson Kellock, Simpsonville, SC (US); Ralph Chris Bruner, Taylors, SC (US)

(73) Assignee: General Electric Company, Schenectady, NY (US)

( * ) Notice: Subject to any disclaimer, the term of this patent is extended or adjusted under 35 U.S.C. 154(b) by 772 days.

(21) Appl. No.: 12/210,439

(22) Filed: Sep. 15, 2008

(65) Prior Publication Data

US 2010/0068041 A1 Mar. 18, 2010

(51) Int. Cl.
*F01D 5/20* (2006.01)

(52) U.S. Cl. ..... 415/173.5; 415/173.1; 415/174.5

(58) Field of Classification Search ..... 415/173.1, 415/173.5, 174.5
See application file for complete search history.

(56) References Cited

U.S. PATENT DOCUMENTS 5,553,999 A * 9/1996 Proctor et al. ..... 415/173.1
6,402,466 B1 6/2002 Burdgick et al.
6,659,472 B2 12/2003 Aksit et al.
7,147,429 B2 12/2006 Czachor et al.

* cited by examiner

*Primary Examiner* — Edward Wojciechowicz
(74) *Attorney, Agent, or Firm* — Cantor Colburn LLP

(57) ABSTRACT

A turbomachine includes a casing defining a hot gas path, and a shroud member attached to the casing. The shroud member is spaced from the casing to define a gap. The shroud member includes a first end having a first hook member provided with a first sealing surface and a second end including a second hook member provided with a second sealing surface. At least one of the first and second sealing surfaces includes a plurality of labyrinth seal elements that reduce air leakage through the gap into the hot gas path.

12 Claims, 3 Drawing Sheets

SHROUD FOR A TURBOMACHINE

BACKGROUND

Exemplary embodiments of the present invention relate to the art of turbomachines and, more particularly, to a shroud for a turbomachine.

Gas turbine engines include a casing that houses a turbine rotor having a plurality of buckets. Hot gases passing from a combustor through a turbine nozzle and along a hot gas path, impinge upon the turbine buckets to spin the turbine rotor. The turbine includes shroud segments that are fixed in an annular array to form a shroud adjacent to tip portions of the buckets. The shroud segments provide protection for the casing. In addition, the shroud segments substantially limit airflow from leaking past the tip portions of the buckets.

BRIEF DESCRIPTION

In accordance with an exemplary embodiment of the invention, a turbomachine includes a casing defining a hot gas path, and a shroud member attached to the casing. The shroud member is spaced from the casing to define a gap. The shroud member includes a first end having a first hook member provided with a first sealing surface and a second end including a second hook member provided with a second sealing surface. At least one of the first and second sealing surfaces includes a plurality of labyrinth seal elements that reduce air leakage through the gap into the hot gas path.

In accordance with another exemplary embodiment of the invention, a shroud member for a turbomachine includes a first end having a first hook member provided with a first sealing surface and a second end including a second hook member provided with a second sealing surface. At least one of the first and second sealing surfaces includes a plurality of labyrinth seal elements that reduce air leakage through the gap into the hot gas path.

DETAILED DESCRIPTION

Figure 1:
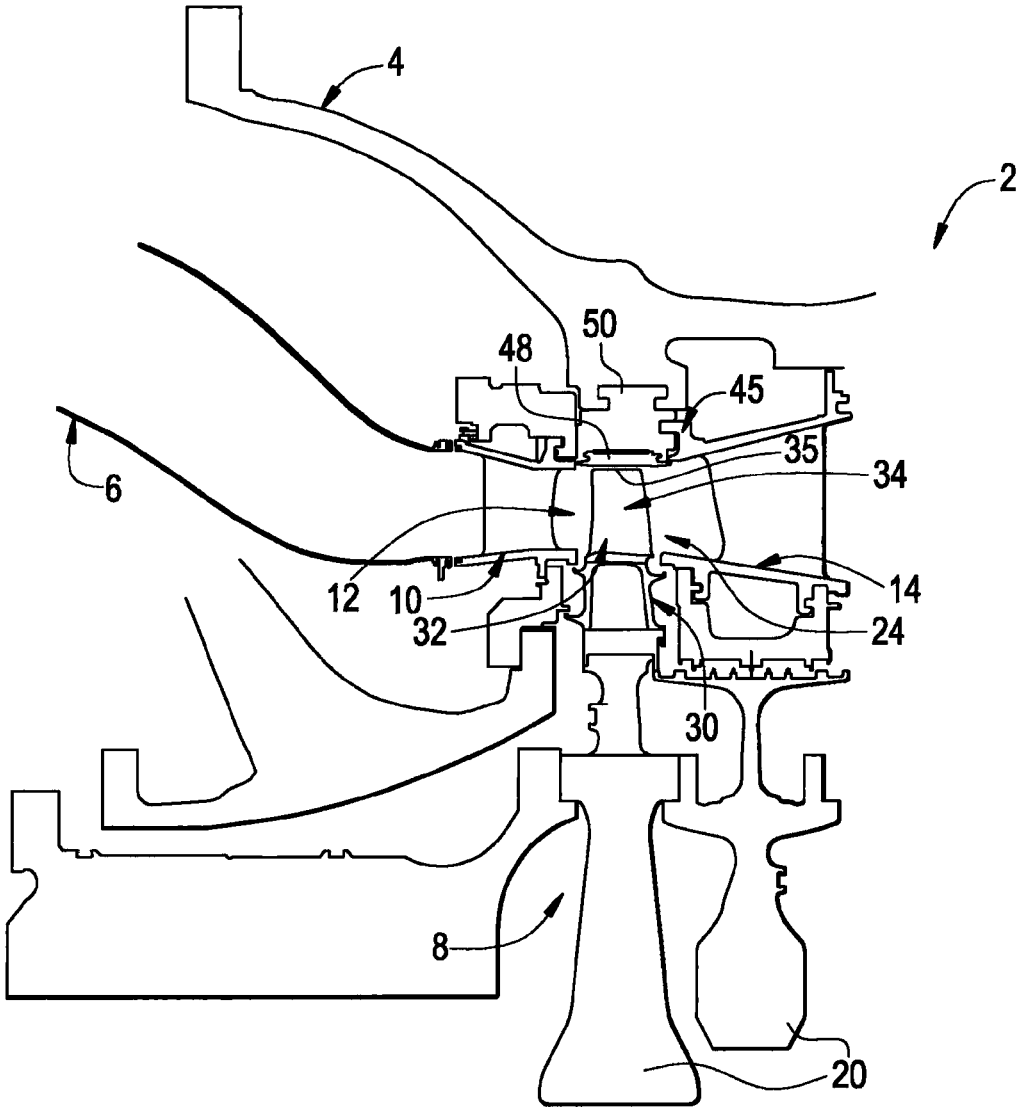
FIG. 1 is a partial cross-sectional view of a turbine portion of a turbomachine including an inner shroud member in accordance with an exemplary embodiment of the invention.

Referring to FIG. 1, a turbomachine constructed in accordance with the present invention is indicated generally at 2. Turbomachine 2 includes a turbine casing 4 that houses a combustion chamber 6 and a turbine stage 8. In the exemplary embodiment shown, turbine stage 8 is a first stage. Combustion gases from combustion chamber 6 pass through a first stage nozzle 10 along a hot gas path (HGP) 12 to a second stage nozzle 14. The combustion gases drive a rotor disk 20 that, in turn drives a turbine shaft (not shown). More specifically, turbine stage 8 includes a plurality of turbine buckets, one of which is indicated at 24, mounted to rotor disk 20. Each turbine bucket 24 includes a base portion 30, and an airfoil portion 32 having a first end section 34 and a second end section 35. The combustion gases passing along hot gas path 12 impinge upon airfoil portion 32 causing rotor disk 20 to rotate.

Figure 2:
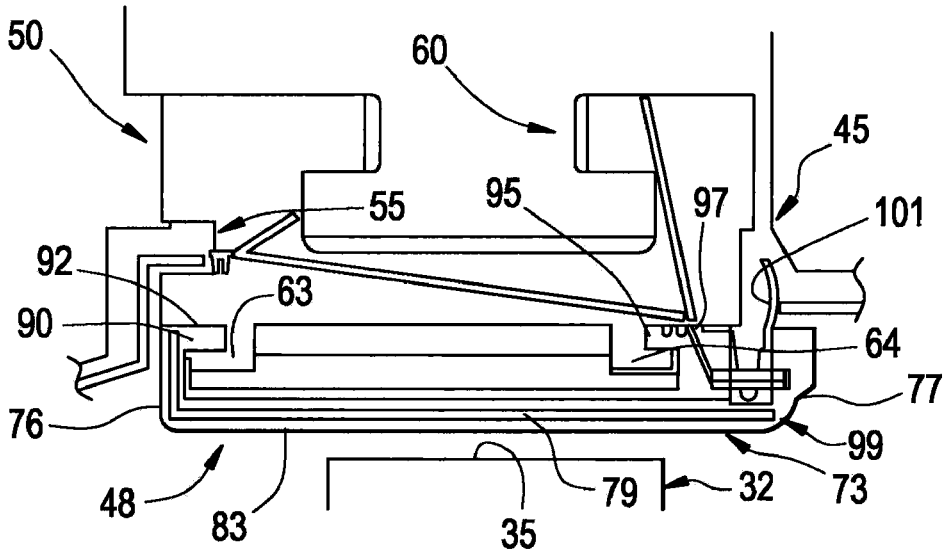
FIG. 2 is a side elevational view of the inner shroud member of FIG. 1.

Turbomachine 2 further includes a shroud assembly 45 having an inner shroud segment or member 48 and an outer shroud segment or member 50. As best shown in FIG. 2, outer shroud member 50 includes a main body section 53 including a first mounting element 55 and a second mounting element 60. First and second mounting elements 55 and 60 secure outer shroud member 50 to turbine casing 4. Outer shroud member 50 is also shown to include first and second hook elements 63 and 64 that serve as an interface with inner shroud member 48. When mounted, inner shroud member 48 is spaced from outer shroud member 50 defining a gap (not separately labeled) through which cooling air may pass into the HGP.

Figure 3:
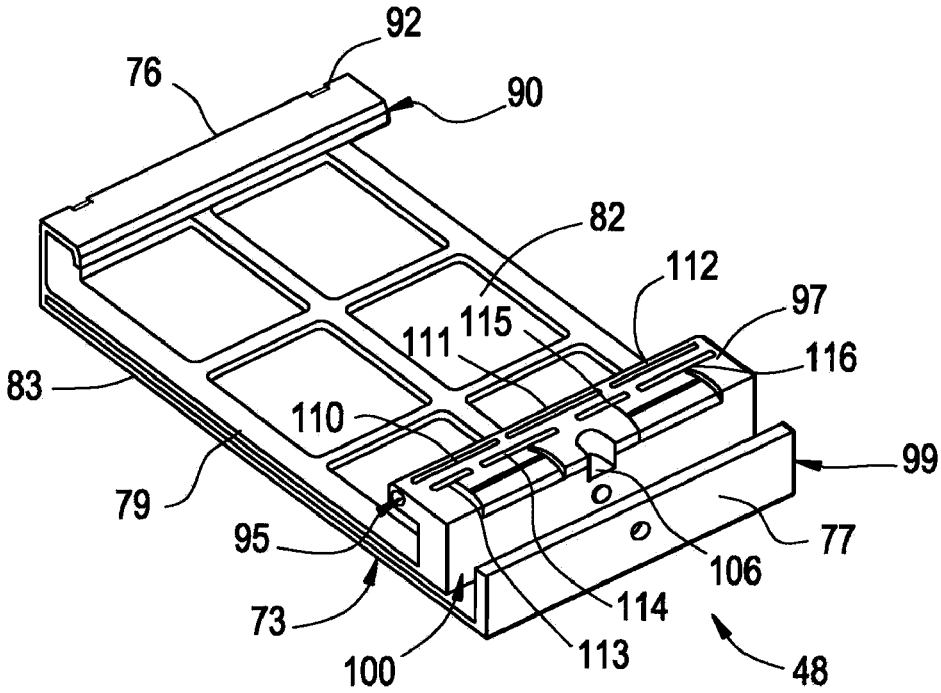
FIG. 3 is a perspective view of the inner shroud member of FIG. 1.
Figure 4:
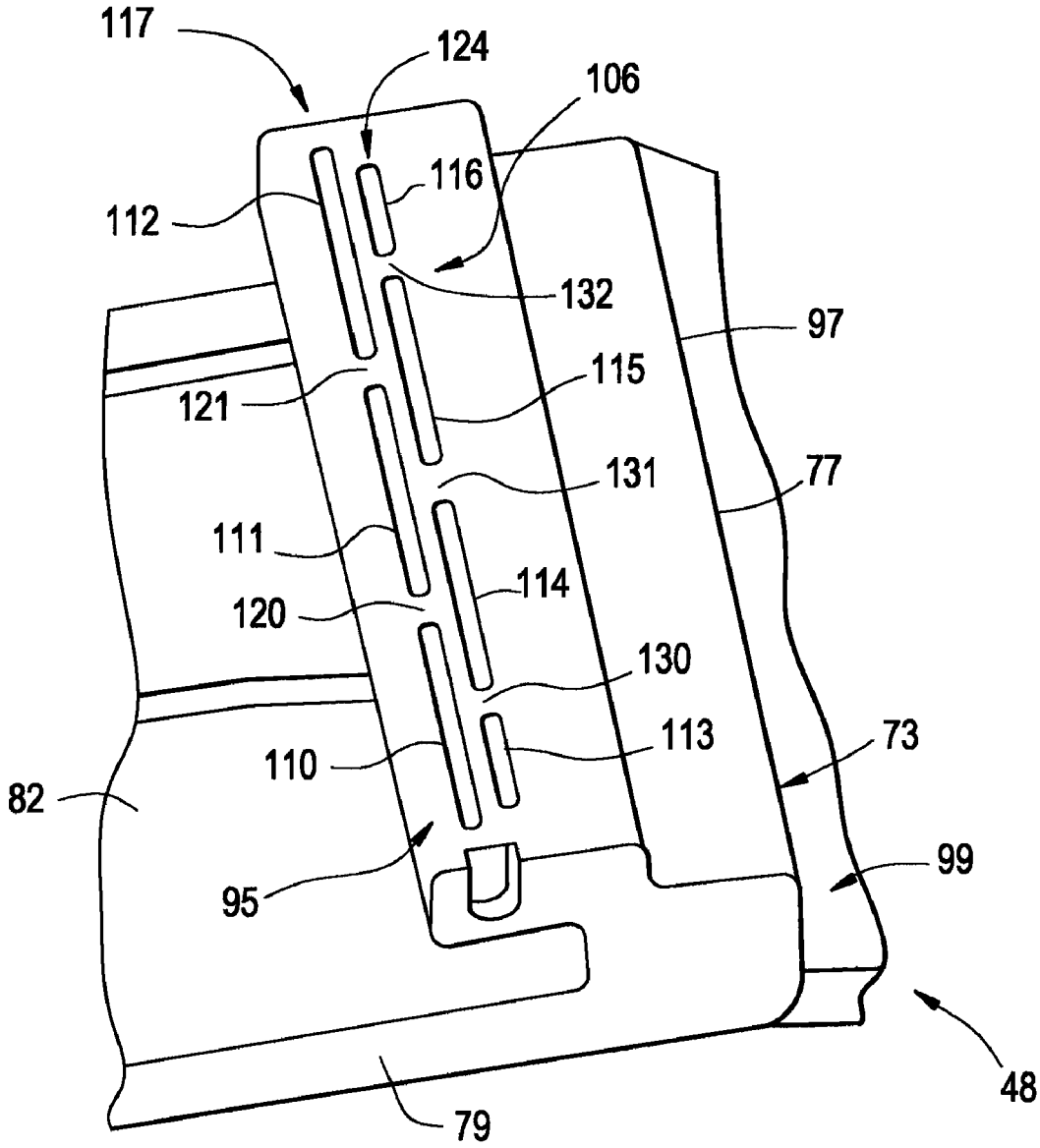
FIG. 4 is a detail view of a labyrinth seal portion of the inner shroud of FIG. 3.

Reference will now be made to FIGS. 3 and 4 in describing inner shroud member 48 constructed in accordance with exemplary embodiments of the invention. As shown, inner shroud member 48 is formed from a nickel-based super alloy and includes a main body portion 73 having a first end 76 that extends to a second end 77 through a wall member 79. Wall member 79 includes a first or inner surface 82, and a second or outer surface 83. Inner shroud member 48 is also shown to include a first hook member 90 having a first sealing surface 92 and a second hook member 95 having a second sealing surface 97. First hook member 90 extends from first end 76 and second hook member 95 extends from second end 77. First and second hook members 76 and 77 engage with hook elements 63 and 64 on outer shroud member 50 to retain inner shroud 48. Inner shroud member 48 further includes a flange 99 having a seal seat 100 that receives a leaf seal assembly 101. Leaf seal assembly 101 provides a first seal between inner shroud member 48 and outer shroud member 50 that prevents cooling air from, for example, a compressor, from entering hot gas path 12. During operation, a tight radial gap exists between first hook member 90 and casing 4 resulting from an axial load created by cooling air pressure. Thus, additional sealing between first hook member 90 and casing 4 is not typically necessary.

In further accordance with the exemplary embodiment shown, inner shroud member 48 includes a labyrinth seal 106 provided on second sealing surface 97. Labyrinth seal 106 includes a plurality of trenches or labyrinth seal elements 110-116. Labyrinth seal elements 110-112 are arranged in a first row 117 that extends longitudinally along second sealing surface 97. Labyrinth seal elements 110-112 extend in a direction tangential to a flow of air passing through a pre-impingement cavity (not separately labeled) that extends between outer shroud member 50 and inner shroud member 48. In this manner, the cooling airflow passes through an impingement plate (not separately labeled) and flows over inner surface 82 to cool inner shroud member 48. In any event, labyrinth seal elements 110-112 are not contiguous, i.e., are spaced one from the other along second sealing surface 97 forming a plurality of gaps 120 and 121. Similarly, labyrinth seal elements 113-116 are arranged in a second row 124 that extends longitudinally along second sealing surface 97, parallel to first row 117. With this arrangement, labyrinth seal elements 113-116 also extend in a direction tangential to a flow of air passing across outer shroud member 50. Labyrinth seal elements 113-116 are spaced one from the other along second sealing surface 97 forming a plurality of gaps 130 and 132. Actually, labyrinth seal elements 110-112 and 113-116 are shifted relative to one another such that gaps 120 and 121 do not align with gaps 130-132. The discontinuity of labyrinth seal element 110-112 and 113-116 creates turbulences that substantially limit the cooling air from entering hot gas path 12. That is, labyrinth seal reduces leakage from the pre-impingement cavity by as much as 10-18%.

At this point it should be understood that the number of seal elements can vary in accordance with the exemplary embodiment. Also, the number of rows can vary without departing from the scope of the invention. It should further be understood that while only shown on second sealing surface, the labyrinth seal can also be provided on the first sealing surface. Finally, the inner shroud member can be formed from a variety of techniques including molding and machining.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the present invention if they have structural elements that do not differ from the literal language of the claims, or if they include equivalent structural elements with insubstantial differences from the literal language of the claims.

The invention claimed is:

1. A turbomachine comprising:

a casing defining a hot gas path;

a shroud member attached to the casing, the shroud member being spaced from the casing to define a gap, the shroud member including a first end having a first hook member provided with a first sealing surface and a second end including a second hook member provided with a second sealing surface, at least one of the first and second sealing surfaces including a plurality of labyrinth seal elements that reduce air leakage through the gap into the hot gas path.

2. The turbomachine according to claim 1, wherein the plurality of labyrinth seal elements comprise a plurality of slots formed in the one of the first and second sealing surfaces.

3. The turbomachine according to claim 2, wherein the plurality of slots extend longitudinally along the one of the first and second sealing surfaces.

4. The turbomachine according to claim 2, wherein the plurality of slots comprise a first plurality of slots arranged in a first row that extends along the one of the first and second sealing surfaces and a second plurality of slots arranged in a second row that extends along the one of the first and second sealing surfaces, the first row being parallel to the second row.

5. The turbomachine according to claim 4, wherein the first plurality of slots are off-set from the second plurality of slots.

6. The turbomachine according to claim 1, wherein the shroud member comprises an inner shroud segment.

7. A shroud member for a turbomachine comprising:

a main body portion including a first end including a first hook member provided with a first sealing surface and a second end including a second hook member provided with a second sealing surface, at least one of the first and second sealing surfaces including a plurality of labyrinth seal elements that reduce air leakage into the hot gas path.

8. The shroud member according to claim 7, wherein the plurality of labyrinth seal elements comprise a plurality of slots formed in the one of the first and second sealing surfaces.

9. The shroud member according to claim 8, wherein the plurality of slots extend longitudinally along the one of the first and second sealing surfaces.

10. The shroud member according to claim 8, wherein the plurality of slots comprise a first plurality of slots arranged in a first row that extends along the one of the first and second sealing surfaces and a second plurality of slots arranged in a second row that extends along the one of the first and second sealing surfaces, the first row being parallel to the second row.

11. The shroud member according to claim 10, wherein the first plurality of slots are off-set from the second plurality of slots.

12. The shroud member according to claim 7, wherein the shroud member comprises an inner shroud segment.

* * * * *